United States Patent [19]

Koppelman et al.

[11] 4,330,032

[45] May 18, 1982

[54] SELF-CLEANING SCREW CONVEYOR

[75] Inventors: Edward Koppelman, 4424 Bergamo Dr., Encino, Calif. 91316; Robert G. Murray, Palo Alto, Calif.

[73] Assignee: Edward Koppelman, Encino, Calif.

[21] Appl. No.: 242,831

[22] Filed: Mar. 12, 1981

[51] Int. Cl.[3] ..... F28F 17/00

[52] U.S. Cl. ..... 165/94; 198/497; 432/121

[58] Field of Search ..... 432/121; 165/94, 95; 198/497, 498

[56] References Cited

U.S. PATENT DOCUMENTS

| | | | |
|---|---|---|---|
| 3,549,000 | 12/1970 | Christian et al. | 198/659 |
| 3,580,389 | 5/1971 | Nonnenmacher | 198/625 |
| 3,704,076 | 11/1972 | Bodunov et al. | 198/497 |

*Primary Examiner*—John J. Camby

*Attorney, Agent, or Firm*—Harness, Dickey & Pierce

[57] ABSTRACT

A screw conveyor apparatus suitable for conveying and processing flowable materials such as particulate materials and slurries, for example, which incorporates cleaning or scraping elements for dislodging the accumulation of materials from the surfaces of the helical flight. The apparatus comprises an elongated housing defining a conveying chamber in which a helical flight is rotatably supported formed with a central axially extending bore through at least a portion of the length thereof and a shaft slidably disposed in the bore and reciprocable and rotatable relative to the helical flight. A series of scraper elements are mounted on the shaft adjacent to the leading and trailing surfaces of the helical flight and a drive mechanism is provided for rotating the helical flight and the shaft. A power mechanism is provided for intermittently or continuously reciprocating the shaft relative to the helical flight to effect a traversing movement of the scraper elements along the helical surfaces to effect dislodgement of any accumulated material therefrom.

21 Claims, 4 Drawing Figures

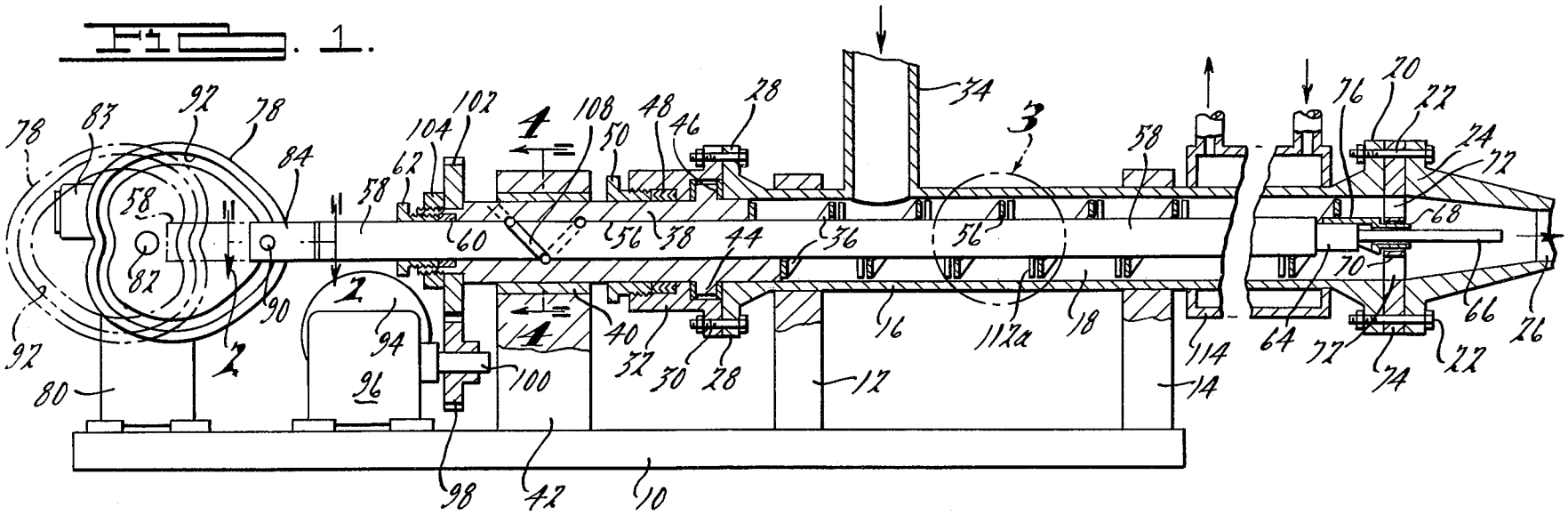
FIG. 1.
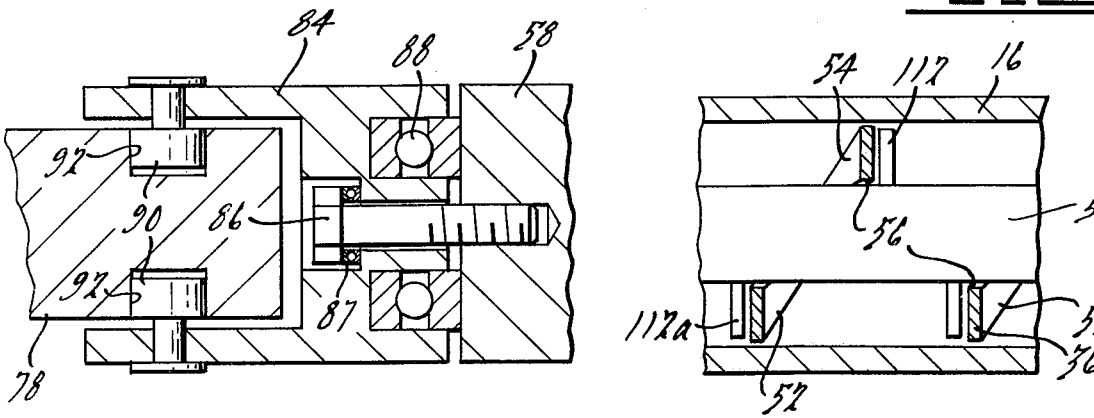
FIG. 2.
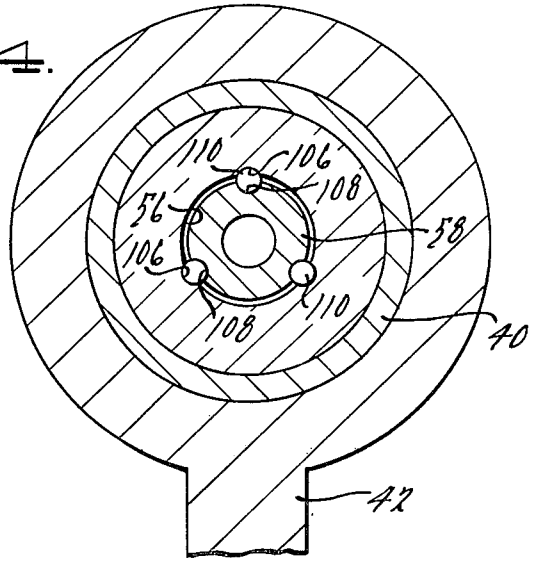
FIG. 3.
FIG. 4.

SELF-CLEANING SCREW CONVEYOR

BACKGROUND OF THE INVENTION

A variety of screw conveying apparatuses have heretofore been used or proposed for use in conveying various flowable materials through a chamber in which they may simultaneously undergo processing through heat exchange in which the material is heated to elevated temperatures. A continuing problem associated with such screw-type conveying apparatuses is the tendency of the material being conveyed or processed to accumulate or become encrusted on the surfaces of the worm or helical auger substantially reducing the conveying efficiency and further causing large variations in the degree of processing to which the materials are subjected.

In recognition of this problem, various screw-type conveying devices have heretofore been proposed which employ a plurality of intermeshing screws or worms which are arranged so that the helical surfaces of the adjacent screws come in contact with each other to impart a scraping action effecting dislodgement of encrustations of accumulated materials thereon. This has been achieved by varying the relative speed of rotation of adjacent screws which may rotate in the same direction or in counter directions as well as by effecting a relative reciprocation of one screw to the other imparting a traversing movement of their helical surfaces. Typical of such prior art constructions are those shown and described in U.S. Pat. Nos. 2,788,195; 3,255,814; 3,506,066; 3,549,000; 3,580,389 and 3,637,069.

In screw conveyor apparatuses of the types described in the aforementioned United States Letters Patent, the use of a plurality of intermeshing screws necessitates a housing of a complex cross sectional configuration to accommodate the several screws with the peripheral edges thereof in close fitting relationship to the inner surfaces of the housing to prevent excessive leakage of the material being conveyed under pressure between the screws and housing. This necessitates a relatively costly structure. In addition, the use of differential speed drive mechanisms to vary the speed of rotation of adjacent screws or to effect axial reciprocation of one screw relative to the other requires very complicated and costly mechanisms to assure proper operation further detracting from the economy of such apparatuses.

The present invention overcomes many of the problems and disadvantages associated with prior art type screw conveyor apparatuses incorporating self-cleaning characteristics by employing a single screw or helical flight enabling use of a conventional circular cylindrical conveying chamber and wherein the cleaning action can be effectively restricted to only those sections of the screw at which objectionable accumulations of material occurs by a mechanism which is relatively simple and inexpensive, of durable construction, of efficient operation, and which can be adapted to apparatuses operating under relatively high pressures and temperatures.

SUMMARY OF THE INVENTION

The benefits and advantages of the present invention are achieved by a screw conveyor apparatus comprising an elongated housing defining a conveying chamber in which a helical flight is rotatably disposed and is formed with a central axially extending bore through at least a portion of the length thereof. A shaft is slidably disposed in the bore of the helical flight and is reciprocable and rotatable relative thereto. A plurality of scraper elements are affixed to the shaft and are disposed adjacent to the leading and trailing surfaces of the helical flight to effect dislodgement of accumulated material therefrom in response to a traversing movement of the scraper elements relative to the helical surfaces. Drive means are provided for rotating the helical flight and the shaft and power means are included for reciprocating the shaft and the helical flight relative to each other on an intermittent or continuous basis to effect a traversing movement of the scraper elements along the helical surfaces.

Additional benefits and advantages of the present invention will become apparent upon a reading of the description of the preferred embodiments taken in conjunction with the accompanying drawing.

BRIEF DESCRIPTION OF THE DRAWING

FIG. 1 is a fragmentary side elevational view partly in section of a screw conveyor apparatus incorporating the preferred embodiments of the present invention;

FIG. 2 is a magnified horizontal cross sectional view of the cam power arrangement and swivel connection at the projecting outer end of the shaft as shown in FIG. 1 and taken substantially along the line 2—2 thereof;

FIG. 3 is a fragmentary magnified vertical sectional view of a portion of the helical flight and shaft and scraper elements thereon as shown in FIG. 1 and enclosed by the dotted circle indicated at 3 thereof but with the shaft in a retracted position; and FIG. 4 is a fragmentary transverse vertical sectional view of the coupling arrangement between the rotary support of the helical flight and shaft as shown in FIG. 1 and taken substantially along line 4—4 thereof.

DESCRIPTION OF THE PREFERRED EMBODIMENTS

Referring now in detail to the drawing and as may be best seen in FIG. 1, a screw conveyor apparatus constructed in accordance with the preferred embodiments of the present invention comprises a base 10 having a pair of vertical support brackets 12,14 affixed thereto which support at their upper end portions, a circular cylindrical housing 16 defining an elongated chamber 18. The forward or right hand end of the housing 16 as viewed in FIG. 1 terminates in a flange 20 which is securely fastened such as by means of bolts 22 to a flanged reducer 24 which terminates in a discharge port 26 for discharging material conveyed through the chamber 18.

The inner or left hand end of the housing 16 as viewed in FIG. 1 terminates in a flange 28 which is removably affixed such as by means of bolts 30 to a tubular sleeve 32. The housing is further provided with an inlet pipe 34 adjacent to the vertical support bracket 12 for introducing feed material into the chamber 18.

A screw or helical flight 36 is rotatably disposed within the chamber 18 of the housing and is securely fastened at its inner or left hand end as viewed in FIG. 1 to a drive sleeve 38 rotatably supported in a bearing 40 of an upright pillow block 42 affixed to the base 10. The helical flight and drive sleeve 38, accordingly, rotate as a unit and are axially fixed by means of an annular collar 44 which is disposed within an annular groove 46 formed in the tubular sleeve 32 incorporating thrust bearing surfaces to prevent axial shifting movement of the helical flight relative to the housing. The drive sleeve 38 is further sealed by means of a chevron packing 48 and threaded gland nut 50 threadably secured to a counterbored outer section of the tubular sleeve 32.

In the embodiment as illustrated, the helical flight is of substantially constant pitch throughout its length and may be of a hollow or solid construction. The helical flight defines a forward or leading helical surface 52 as best seen in FIG. 3 and a rearward or trailing helical surface 54. The helical flight is further formed with a central axially extending bore 56 which also extends in axial alignment through the connected tubular drive sleeve 38. The helical flight or helical ribbon 36 is supported by the drive sleeve 38 and is further supported by means of a longitudinal centrally extending shaft 58 disposed within the bore 56 and in sliding clearance relationship relative to the inner edge surfaces of the helical flight defining the bore 56. The shaft 58 is mounted within the helical flight and drive sleeve for relative rotation and axial reciprocation in a manner and for the purposes subsequently to be described.

The shaft 58 extends outwardly of the left hand end of the drive sleeve 38 as viewed in FIG. 1 and is rotationally sealed by means of a seal member 60 retained by a gland nut 62 threadably secured in a threaded counter bore formed at the left hand end of the drive sleeve 38. The forward or right hand end of the shaft 58 as viewed in FIG. 1 is of a concentric stepped configuration including an intermediate section 64 and a stub shaft section 66. The stub shaft section 66 is rotatably supported for axial reciprocation in a bushing 68 which in turn is rotatably supported in an annular bearing sleeve 70 supported by means of a plurality of vanes 72 extending radially from an annular plate 74 securely clamped between the flange 20 and flanged reducer 24. The bushing 68 includes a partial circular extention 76 which is securely affixed to the forward or right hand end of the helical flight as viewed in FIG. 1 and overlies the intermediate section 64 of the shaft 58. In accordance with this arrangement, the shaft 58 is rotatably supported within the bushing 68 and its forward stub shaft section 66 is permitted to longitudinally reciprocate in response to the axial reciprocation of the shaft while the forward portion of the helical flight remains rotatably supported by the bearing sleeve through the extention 76.

An intermittent or substantially continuous axial reciprocation of the shaft 58 is achieved in accordance with the embodiment shown by a rotary heart-shaped cam 78 mounted on a cam drive riser 80 affixed to the left hand end of the base 10 as shown in FIG. 1. The cam 78 is affixed to a drive shaft 82 which is drivingly coupled through a suitable gear reducer (not shown) to a drive motor 83 effecting rotation of the cam through 360 degrees and a corresponding axial reciprocation of the shaft 58 connected thereto.

As shown in FIGS. 1 and 2, the outer end of the shaft 52 is connected to a swivel yoke 84 by means of a cap screw 86 having a thrust washer 87 under the head thereof and thrust ball bearing 88 such that the shaft 58 can rotate while the yoke 84 remains rotationally fixed. The swivel yoke 84 is provided with two rotary opposed cam followers 90 which are respectively disposed within a heart-shaped cam track 92 formed in opposite faces of the rotary cam. As the rotary cam 78 rotates, the shaft 58 through the swivel yoke assembly is caused to axially reciprocate from a fully forward position as shown in solid lines in FIG. 1 to a retracted position as shown in phantom. The reciprocating movement of the shaft can be performed on a continuous basis in response to constant rotation of the rotary cam or can be effected intermittently by intermittent energization of the drive motor 83 to achieve satisfactory cleaning of the helical surfaces of the helical flight.

Rotation of the helical flight 36 and the drive sleeve 38 connected thereto is achieved as shown in FIG. 1 by means of a motor 94 drivingly connected to a speed reducer 96 having pinion gear 98 affixed to an output shaft 100 thereof. The pinion gear 98 is disposed in meshing relationship with a driven gear 102 affixed to the drive sleeve 38 such as by means of splines or a key (not shown) and securely locked thereto by means of a lock nut 104. The drive sleeve and helical flight, accordingly, rotate as a unit whereby feed material entering the inlet pipe 34 is conveyed by the helical flight toward the right as viewed in FIG. 1 and out through the discharge port 26.

Rotation of the shaft 58 is achieved by a ball-groove coupling arrangement as best seen in FIGS. 1 and 4 whereby rotation of the drive sleeve imparts rotation to the shaft while at the same time enabling relative reciprocation of the shaft and a reduction or increase in the shaft's speed of rotation during such periods of reciprocation. The coupling as shown, comprises three semi-circular helical grooves 106 in the inner surface of the drive sleeve in the portion disposed within the pillow block 42 and a corresponding three semi-circular helical grooves 108 in the periphery of the shaft 58. A plurality of spherical elements such as hardened balls 110 are disposed within the circular helical groove defined by the grooves 106,108 and serve to transmit torque from the drive sleeve to the shaft 58 to effect rotation thereof. The pitch of the helical grooves 106,108 corresponds to the pitch of the helical flight and extends through an angularity of about 360 degrees around the shaft and drive sleeve.

The cleaning action of the leading and trailing helical surfaces of the helical flight is achieved by means of a plurality of scraper elements as shown in FIGS. 1 and 3 which are affixed to and project radially from the shaft 58 to a distance overlying the leading surface 52 and trailing surface 54 of the flight. The scraping elements are disposed adjacent to such helical surfaces and are formed with a scraping edge of a contour corresponding to the contour of the helical surface adjacent thereto. In the arrangement as illustrated, the scraping elements 112 are disposed at axially spaced intervals along the shaft and at 180 degrees from the adjacent scraping element and alternate in position adjacent to the leading helical surface 52 and the trailing helical surface 54. It will be appreciated that while the scraper elements 112 are illustrated as being positioned along the entire length of the helical flight in FIG. 1, such scraper elements can be selectively positioned along those sections of the helical flight at which the feed material has a tendency to adhere to the helical surfaces. It will also be appreciated that the scraper elements can be secured to the shaft at angular intervals of greater than 180 degrees or less than 180 degrees in consideration of the reciprocating travel of the shaft and the helical pitch of the helical flight to provide for appropriate traversing movement of the scraper elements to achieve satisfactory cleaning of all or selected sections of the helical surfaces.

The specific arrangement as illustrated employs a rotary cam which provides for an axial reciprocating stroke of the shaft equal to the helical pitch of the helical flight whereby the shaft and the scraper elements thereon through the helical ball-groove coupling undergoes one complete revolution relative to the helical flight effecting a scraping traversing movement across 360 degrees of the helical surfaces during each reciprocating travel of the shaft. For example, a helical scraper element indicated at 112*a* as shown in the encircled area indicated at 3 in FIG. 1 which is positioned rearwardly and in scraping relationship against the trailing helical surface when the shaft is in the fully forward position travels during the retracting stroke of the shaft to the position indicated at 112*a* in FIG. 3 of the drawing. In the arrangement shown, it is preferred that the shaft be rotated slightly more than one relative revolution in order to get some overlapping of the scraping action of adjacent scraping elements to assure appropriate cleaning. If the reciprocating travel of the shaft relative to the helical flight pitch is only a fraction of the helical pitch, then the scraping element operative to clean the trailing helical surface and the scraping elements operative to clean the leading helical surface are axially spaced respectively from the adjacent scraping element a maximum of the total helical stroke to achieve a traversing movement over the entire surfaces to be cleaned.

In accordance with the foregoing arrangement, when the shaft is axially stationary with respect to the helical flight, both the helical flight and shaft rotate in unison at the same speed. During the retracting movement of the shaft, the shaft rotates at a slower speed whereas during the forward or inward stroke, the shaft and scraping elements rotate at a faster speed than the helical flight. Usually, the rotary cam 78 controlling reciprocation of the shaft may vary from 0 up to about 2 RPM to achieve appropriate cleaning depending on the particular nature of the material being conveyed. This can be done on a continuous basis or the drive motor 83 can be intermittently energized by means of a suitable timer to effect periodic reciprocation of the shaft to maintain satisfactory conveying efficiency of the helical flight.

The apparatus as hereinbefore described can be arranged with the chamber in a horizontal, vertical or angularly inclined position and is particularly adaptable for processing materials under high pressure and at elevated temperature to effect a desired reaction or thermal restructuring or mixing of the feed material as may be desired. For example, the process can be employed for upgrading lignitic-type coal and other carbonaceous materials in accordance with the process disclosed in U.S. Pat. Nos. 4,052,168 and 4,129,428 employing an apparatus as disclosed in U.S. Pat. No. 4,126,519 the substance and teachings of which are incorporated herein by reference. The feed materials may comprise any flowable materials such as in a particulated or in a form of a slurry which can be introduced into the conveying chamber and conveyed by means of the rotating helical flight from the inlet to the discharge end thereof. The material while in the chamber can be subjected to a heat exchange for controlling the temperature thereof including a heating of the material to an elevated temperature in accordance with the aforementioned United States Patents to effect a thermal restructuring thereof. For this purpose, the housing is provided with a heat exchanger indicated at 114 in FIG. 1 defining a chamber encircling the periphery of a section of the housing through which a heat exchange fluid such as steam, for example, can be circulated. Alternatively, a fluid such as super heated steam can be directly injected into the chamber at one or more selected positions there along to achieve the desired heating of the material.

While it will be apparent that the invention herein described is well calculated to achieve the benefits and advantages set forth, it will be appreciated that the invention is susceptible to modification, variation and change without departing from the spirit thereof.

What is claimed is:

1. A screw conveyor apparatus comprising an elongated housing defining a conveying chamber, a helical flight defining a helical leading surface and trailing surface rotatably supported in said housing having a central axially extending bore through at least a portion of the length thereof, a shaft slidably disposed in said bore and reciprocable and rotatable relative to said helical flight, scraper means on said shaft disposed adjacent to said leading and said trailing surface of said helical flight, drive means for rotating said helical flight and said shaft and power means for reciprocating said shaft and said helical flight relative to each other for effecting traversing movement of said scraper means along said leading and said trailing surface of said helical flight.

2. The apparatus as defined in claim 1 further including an inlet port in said housing for introducing a feed material into said chamber and an outlet port in said housing longitudinally spaced from said inlet port for discharging the material therefrom.

3. The apparatus as defined in claim 2 further including heat exchange means for controlling the temperature of the feed material in said chamber.

4. The apparatus as defined in claim 3 in which said heat exchange means is operative to heat the feed material to an elevated temperature.

5. The apparatus as defined in claim 1 further including seal means for sealing said helical flight and said shaft within said chamber.

6. The apparatus as defined in claim 1 in which said bore extends through the entire length of said helical flight.

7. The apparatus as defined in claim 1 in which said helical flight is axially fixed in said housing and said shaft is axially reciprocable relative thereto.

8. The apparatus as defined in claim 1 in which said helical flight is of substantially constant helical pitch along the length thereof.

9. The apparatus as defined in claim 1 in which said scraper means are disposed at selected positions along the length of said shaft.

10. The apparatus as defined in claim 1 in which said scraper means are disposed on said shaft at an axially spaced interval corresponding to about one-half the length of the helical pitch of said helical flight.

11. The apparatus as defined in claim 1 in which said scraper means include a substantially radially extending scraper edge of a contour substantially corresponding to the contour of said helical surface adjacent thereto and disposed in scraping relationship thereto for removing material from said helical surface in response to the relative traversing movement of said scraper means along said helical surface.

12. The apparatus as defined in claim 1 in which said scraper means include a first plurality of blades disposed at axially spaced intervals along said shaft and adjacent to said helical leading surface and a second plurality of blades disposed at axially spaced intervals along said shaft and adjacent to said helical trailing surface.

13. The apparatus as defined in claim 12 in which said first blades are axially spaced from each other a longitudinal distance no greater than the length of the reciprocating stroke of said shaft.

14. The apparatus as defined in claim 12 in which said second blades are axially spaced from each other a distance no greater than the length of the reciprocating stroke of said shaft.

15. The apparatus as defined in claim 1 in which said drive means comprises gear means drivingly connected to said helical flight for effecting rotation thereof.

16. The apparatus as defined in claim 1 in which said drive means includes means for rotating said helical flight and coupling means for rotating said shaft in response to rotation of said helical flight.

17. The apparatus as defined in claim 16 in which said coupling means include means for providing relative reciprocation between said helical flight and said shaft.

18. The apparatus as defined in claim 16 in which said coupling means comprises a helical groove formed around said shaft and in the adjacent surface of said bore and a plurality of rolling elements in said helical groove forming a driving connection between said helical flight and said shaft.

19. The apparatus as defined in claim 1 in which said power means includes a rotary cam drivingly connected to said shaft for effecting reciprocation thereof in response to rotation of said cam.

20. The apparatus as defined in claim 1 in which said drive means is controlled to provide intermittent relative reciprocation of said shaft and said helical flight.

21. The apparatus as defined in claim 1 in which said drive means is controlled to provide substantially constant relative reciprocation of said shaft and said helical flight.

* * * * *